United States Patent [19]

Groeneveld et al.

[11] Patent Number: 4,950,384

[45] Date of Patent: Aug. 21, 1990

[54] PROCESS FOR THE HYDROCRACKING OF A HYDROCARBONACEOUS FEEDSTOCK

[75] Inventors: Dees J. W. Groeneveld, The Hague; Swan T. Sie, Amsterdam, both of Netherlands

[73] Assignee: Shell Oil Company, Houston, Tex.

[21] Appl. No.: 373,711

[22] Filed: Jun. 29, 1989

[30] Foreign Application Priority Data

Aug. 11, 1988 [GB] United Kingdom ..... 8819122

[51] Int. Cl.[5] ..... C10G 65/10

[52] U.S. Cl. ..... 208/59; 208/95; 208/100

[58] Field of Search ..... 208/59, 100, 95

[56] References Cited

U.S. PATENT DOCUMENTS

| | | | |
|---|---|---|---|
| 2,243,519 | 1/1981 | Schorfheide | 208/59 |
| 3,540,999 | 11/1970 | Jacobs | 208/59 |
| 3,779,897 | 12/1978 | Wrench et al. | 208/89 |
| 3,891,539 | 6/1975 | Nelson et al. | 208/59 |
| 4,058,449 | 11/1977 | Reitz et al. | 208/59 |
| 4,176,048 | 11/1979 | Corns et al. | 208/59 |
| 4,501,653 | 2/1985 | Hamner | 208/89 |
| 4,576,710 | 3/1986 | Nongbri et al. | 208/210 |
| 4,828,676 | 5/1989 | Sawyer et al. | 208/59 |

FOREIGN PATENT DOCUMENTS 2622426 12/1976 Fed. Rep. of Germany .

*Primary Examiner*—Anthony McFarlane
*Attorney, Agent, or Firm*—Kimberly L. Muller

[57] ABSTRACT

A hydrocarbonaceous feedstock is hydrocracked by contacting the feedstock in a first reaction stage at elevated temperature and pressure in the presence of hydrogen with a first hydrocracking catalyst to obtain a first effluent, separating from the first effluent a gaseous phase and a liquid phase at substantially the same temperature and pressure as prevailing in the first reaction stage, contacting the liquid phase of the first effluent in a second reaction stage at elevated temperature and pressure in the presence of hydrogen and a second hydrocracking catalyst to obtain a second effluent, obtaining at least one distillate fraction and a residual fraction from the combination of the gaseous phase and the second effluent by fractionation, and recycling at least a part of the residual fraction to a reaction stage.

8 Claims, 1 Drawing Sheet

PROCESS FOR THE HYDROCRACKING OF A HYDROCARBONACEOUS FEEDSTOCK

FIELD OF THE INVENTION

The present invention relates to a process for the hydrocracking of a hydrocarbonaceous feedstock in which a plurality of reaction stages are employed.

Hydrocracking is a well-established process in which heavy hydrocarbons are contacted in the presence of hydrogen with a hydrocracking catalyst. The temperature and the pressure are relatively high, so that the heavy hydrocarbons are cracked to products with a lower boiling point. Although the process can be carried out in one stage, it has shown to be advantageous to carry out the process in a plurality of stages. In a first stage the feedstock is subjected to denitrogenation, desulfurization and hydrocracking, and in a second stage most of the hydrocracking reactions occur.

The presence of nitrogen compounds in the feedstock may lead to problems as, generally, hydrocracking catalysts are nitrogen-sensitive and may be deactivated by the nitrogen compounds. Therefore it has been proposed to remove the nitrogen compounds from the effluent of the first stage. The nitrogen compounds, generally being ammonia, may be washed by subjecting the first stage effluent to a treatment with an aqueous solution of e.g. a mineral acid. Apart from the fact that the washing procedure does not always remove the organic nitrogen compounds that may remain in the effluent, there is the other drawback that the effluent needs to be cooled off significantly in order to obtain a satisfactory removal of the ammonia. Another drawback of the above procedure resides in the fact that hydrocarbonaceous products that have already been cracked and are valuable desired products, remain in the effluent and can again be cracked in the second stage to yield less desired lighter or eve undesired gaseous products.

BRIEF DESCRIPTION OF THE INVENTION

It has now been found that the above drawbacks are overcome if the first stage effluent is subjected to a separation between gaseous and liquid products at essentially the same temperature and pressure as prevail in the first stage.

DETAILED DESCRIPTION OF THE INVENTION

Accordingly, the present invention provides a process for the hydrocracking of a hydrocarbonaceous feedstock which process comprises contacting the feedstock in a first reaction stage at elevated temperature and pressure in the presence of hydrogen with a first hydrocracking catalyst to obtain a first effluent, separating from the first effluent a gaseous phase and a liquid phase at substantially the same temperature and pressure as prevailing in the first reaction stage, contacting the liquid phase of the first effluent in a second reaction stage at elevated temperature and pressure in the presence of hydrogen with a second hydrocracking catalyst to obtain a second effluent, obtaining at least one distillate fraction and a residual fraction from the gaseous phase and the second effluent by fractionation, and recycling at least a part of the residual fraction to a reaction stage.

By carrying out the separation at essentially the same temperature as prevailing in the first reaction stage there is no need for expensive cooling and heating processes. Further, due to the relatively high temperature at which the separation is carried out the solubility of ammonia in the liquid phase will be negligible and cracked products will be entrained with the gaseous phase so that there is no risk of overcracking. The cracked products that ar contained in the gaseous phase include valuable middle distillates. Moreover, since there is no risk of overcracking in the second stage the cracking duty in the first stage may be increased, if that would be desired. Finally, by the removal of the cracked products in the separation stage the quantity of material that is to be processed in the second reaction stage is reduced, so that a smaller reactor may suffice.

A part of the residual fraction is recycled to a reaction stage. It is preferred to recycle the complete residual fraction. This has the advantage that the complete feedstock is hydrocracked to products with a lower boiling point. This part or the complete residual fraction may be recycled to the first reaction stage. However, since the residual fraction is substantially nitrogen-free and since most of the hydrocracking reactions occur in the second reaction stage, it is preferred to pass at least part of the residual fraction to the second reaction stage. Thereto it is convenient to combine it with the liquid phase of the first effluent before it is passed to the second reaction stage.

The gaseous phase of the first effluent contains hydrogen and ammonia and generally hydrogen sulfide, and the second effluent comprises at least hydrogen. It is preferred to remove the ammonia and the hydrogen sulfide from the process and to recover the hydrogen which can be recycled to the hydrocracking reactors. Therefore, preferably the gaseous phase of the first effluent and the second effluent are subjected to a removal step of ammonia and hydrogen before being subjected to fractionation. The procedures for the removal of hydrogen, ammonia (and hydrogen sulfide) are known in the art and do not need to be described here.

Hydrocarbonaceous feedstocks that can be used in the present process include gas oils, vacuum gas oils, deasphalted oils, long residues, short residues, catalytically cracked cycle oils, thermally cracked gas oils and syncrudes, optionally originating from tar sands, shale oils, residue upgrading processes or biomass. Combinations of various hydrocarbonaceous feedstock can also be employed. The hydrocarbonaceous feedstock will generally be such that a major part, say over 50 % wt, has a boiling point above 370° C. The present process is most advantageous when the feedstock contains nitrogen. Typical nitrogen contents are in the range of up to 5000 ppmw. Nitrogen contents may start from 50 ppmw. The feedstock will generally also comprise sulphur compounds. The sulphur content will usually be in the range from 0.2 to 6 % wt.

The separation of a gaseous and a liquid phase of the first effluent takes place at essentially the same temperature and pressure as prevailing in the first reaction stage. Conveniently this is achieved by refraining from cooling or heating the first effluent. In one embodiment the effluent is passed to a separate separation vessel. This separation vessel may consist of any suitable device known in the art for the separation of a gas and a liquid. Advantageously, the separation vessel is a settling vessel from which at a lower portion the liquid is withdrawn and from an opening above the liquid level the gas is withdrawn. In a preferred embodiment the first reaction stage and the separation are carried out in the same reaction vessel. This can be achieved by the creation of a settling area in the bottom part of the reaction vessel, from which the gaseou phase and the liquid phase are withdrawn via different openings. This embodiment entails the advantage that no separate separation vessel is needed.

The temperature and the pressure of the separation are substantially the same as those prevailing in the first reaction stage. It will be appreciated that minor fluctuations in the reaction conditions in the first reaction stage may occur. The temperature and the pressure in the separation are then preferably substantially the same as those prevailing in the exit part of the first reaction zone. These conditions suitably include a temperature of 320 to 450° C. and a pressure of 50 to 250 bar. Preferably, the temperature is from 375 to 425° C. and the pressure is from 75 to 150 bar.

As to the process conditions in the first reaction stage it is clear that the temperature and pressure will conveniently be from 320 to 450° C. and from 50 to 250 bar, respectively. More preferably, the temperature and pressure are from 375 to 425° C. and 75 to 150 bar. The hydrogen/oil ratio in the first reaction stage is suitably from 500 to 5000 N1/kg, more preferably from 1000 to 2500 N1/kg, and the space velocity from 0.1 to 10 kg/1/h, more preferably from 0.2 to 5 kg/1/h.

The catalyst in the first stage is preferably a hydrocracking catalyst which also has hydrodenitrogenation activity. Suitable catalysts include a refractory oxide in combination with a group 8 and/or group **6*b* metal or component thereof. Suitable refractory oxides include alumina, silica, silica-alumina, magnesia, titania, zirconia and clays. Preferably the catalyst is a alumina-based catalyst with a group 8 and/or group 6*b*** metal or component thereof.

The catalytically active metal from groups 8 and **6*b* are preferably selected from cobalt, nickel, platinum, palladium, tungsten and molybdenum. Preferably non-noble metal mixtures are used, such as Ni-W, Ni-Mo, Co-Mo and Co-W. The catalyst may further contain phosphorus and/or fluorine to boost its activity. When the catalytically active metals are non-noble they are preferably present on the first hydrocracking catalyst in an amount of 1 to 16 % wt. of a group 8 metal and/or from 6 to 24 % wt. of a group 6*b*** metal, the weight percentages being based on the total catalyst. Noble metals are suitably present in a lower amount, e.g. from 0.2 to 2 % wt. Especially when the catalytically active metal are non-noble they are preferably present in their oxidic or even more preferred in their sulphidic form. The preparation of the first hydrocracking catalyst is known in the art.

The second hydrocracking catalyst is preferably different from the first hydrocracking catalyst. The second hydrocracking catalyst may be sensitive to nitrogen compounds. Suitable catalysts include hydrocracking catalysts based on silica-alumina and zeolites. Silica-alumina-based catalysts which tend to be highly nitrogen-sensitive, can be used because of the efficient ammonia removal in the interstage separation. Since zeolitic hydrocracking catalysts tend to be more active, they are especially preferred. Suitable zeolitic catalysts comprise a faujasite-type zeolite, in particular zeolite Y. The silica/alumina molar ratio in such zeolites may vary from 4 to 25, in particular from 6 to 15. The unit cell size of zeolite Y may vary from 2.419 to 2.475 nm, in particular from 2.425 to 2.460 nm. Apart from the zeolite the second hydrocracking catalyst conveniently comprises further catalytically active metals and at least on binder. The binder is suitably selected from silica, alumina, thoria, titania, silica-alumina, zirconia, magnesia and mixtures thereof. In particular alumina is preferred, optionally in combination with silica-alumina.

The catalytically active components on the second hydrocracking catalyst are the same as those on the first hydrocracking catalyst, i.e. a group 8 and/or a group **6*b* metal or compound thereof. Nickel, cobalt, platinum, palladium, tungsten and molybdenum are preferred. The non-noble metals are preferably in their oxidic or sulfidic form. The amounts of the metals are preferably from 2 to 25 % wt. of a group 6*b* metal, from 1 to 16 wt. of a group 8 metal when the group 8 metal is not noble and from 0.2 to 2 % wt. of a noble group 8** metal, all percentages being based on total catalyst.

The process conditions prevailing in the second reaction stage are preferably a temperature from 300 to 425° C., a pressure from 50 to 250 bar, a space velocity from 0.1 to 10 kg/1/h, and a hydrogen/oil ratio of 250 to 5000 N1/kg.

BRIEF DESCRIPTION OF THE INVENTION

The process will be further illustrated by means of the following Figures. For the sake of simplicity various types of equipment that are not essential to the invention, are not shown.

DETAILED DESCRIPTION OF THE INVENTION

Figure 1:
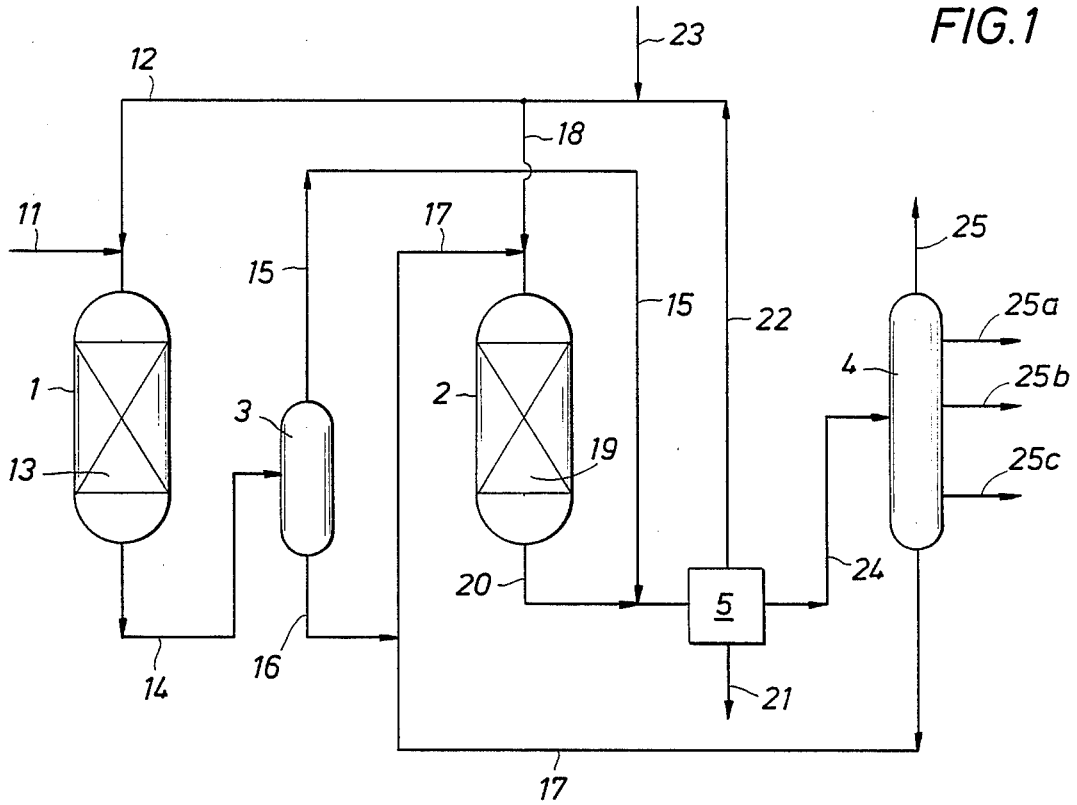
FIG. 1 shows on embodiment of the present process in which use is made of a separate separation vessel.

In FIG. 1 a first hydrocracking reactor 1 is shown which contains one or more catalyst beds. In the Figure one catalyst bed 13 is shown, comprising a first hydrocracking catalyst, e.g. an alumina-based catalyst loaded with nickel and molybdenum. A hydrocarbonaceous feedstock is passed through a line 11 and mixed with a hydrogen-containing gas supplied via a line 12. The mixture is passed through the catalyst bed(s) and a first effluent is withdrawn at the bottom of the first reactor via a line 14. The first effluent is passed to a separation vessel 3 which operates at substantially the same temperature and pressure as used in reactor 1 In separation vessel 3 a gaseous phase is separated from a liquid phase. The liquid phase is withdrawn via a line 16 and is subsequently mixed with a residual fraction supplied via a line 17. The mixture is then passed to second hydrocracking reactor 2 via line 17 after having been mixed with a hydrogen-containing ga supplied via line 18. The second hydrocracking reactor 2 contains one or more catalyst beds, here indicated as catalyst bed 19. The catalyst in the second reactor 2 is advantageously an amorphous silica-alumina carrier loaded with nickel/-tungsten or nickel/molybdenum or a zeolite Y-containing carrier loaded with nickel/tungsten or nickel/-molybdenum. In hydrocracking reactor 2 the mixture from the line 17 is hydrocracked and a second effluent is discharged via line 20, where it is mixed with the gaseous phase of the first effluent from the line 15. The resulting mixture is passed to a separation section 5 where in several stages hydrogen is recovered from the second effluent, ammonia and hydrogen sulfide that have been formed during the process are removed and a hydrocarbonaceous product is obtained. The hydrogen is recovered via a line 22, where it is mixed with make-up hydrogen supplied via a line 23. The line 22 then splits into the lines 12 and 18 that provide the hydrogen for the reactors 1 and 2, respectively. The waste ammonia and hydrogen sulphide are discharged via line 21 and can be subjected to gas purification and sulphur recovery. The hydrocarbonaceous product is passed via a line 24 to a fractionation section, here indicated as a fractionator 4, where it is divided into gaseous and liquid distillate fractions that are recovered via lines 25, **25*a*, 25*b* and 25*c*. The residue of the fractionation is withdrawn via the line 17**. It will be apparent that the cut point for the residual fraction can be arranged at will in accordance with the desired products.

Figure 2:
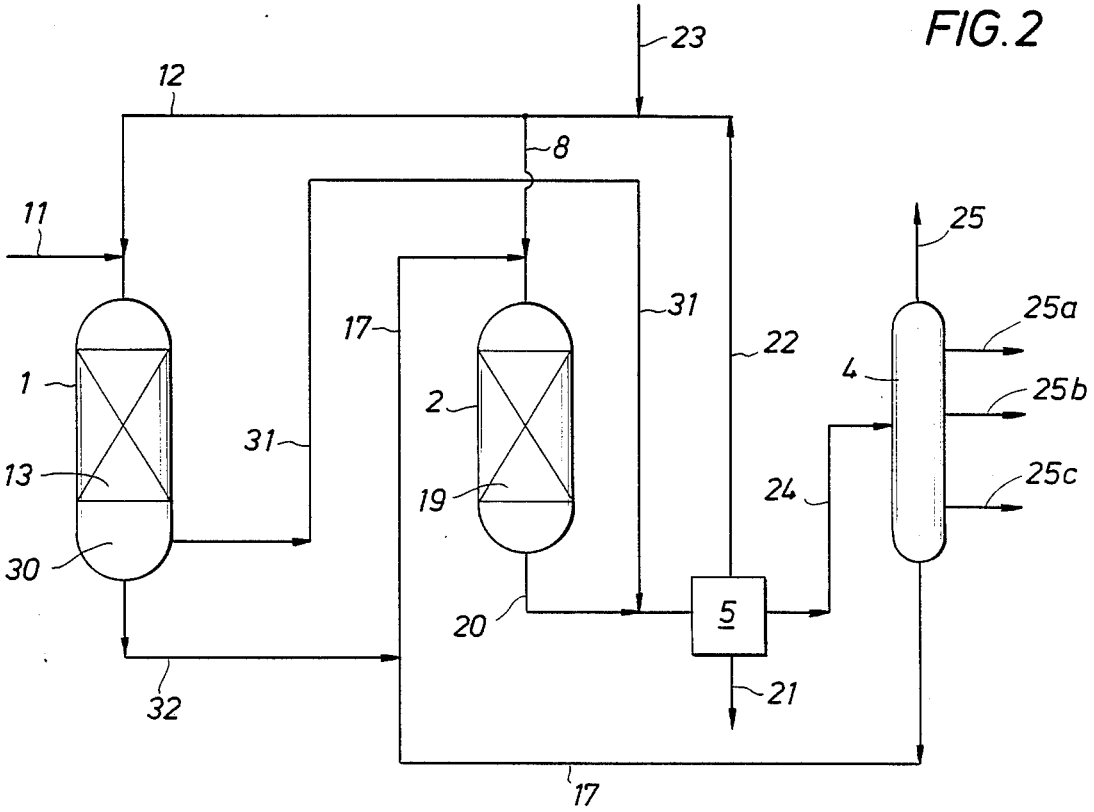
FIG. 2 shows preferred embodiment in which no separation vessel is needed.

In the embodiment of FIG. 2 the separation vessel has been deleted. The numbering of equipment in FIG. 2 is the same as in FIG. 1 when reference is made to corresponding equipment. The hydrocarbonaceous feedstock is mixed with a hydrogen-containing gas and passed to the first hydrocracking reactor 1. The reactor 1 is provided with a settling area 30. When the feedstock has passed the catalyst bed(s) 13, a first effluent enters the settling zone 30 and a separation occurs between a gaseous and liquid phase. The liquid phase is withdrawn from the reactor at the bottom of the reactor 1 via a line 32, and the gaseous phase is withdrawn from the reactor 1 at a higher position via a line 31. The liquid phase in line 32 is mixed with the residual fraction from fractionator 4 in line 17 and is subsequently cracked in second hydrocracking reactor 2. The second effluent is withdrawn via line 20, mixed with the gaseous phase of the first effluent from line 31 and the resulting mixture is worked up as described for the embodiment of FIG. 1.

What we claim as our invention is:

1. A process for hydrocracking a hydrocarbonaceous feedstock which comprises:

a. contacting said feedstock with hydrogen-containing gas in a first reaction zone maintained at first reaction zone temperature and pressure conditions and containing a first hydrocaracking catalyst to obtain a first reaction zone effluent stream;

b. separating said first reaction zone effluent stream at substantially said first reaction zone temperature and pressure conditions to form a first gaseous effluent phase and a first liquid effluent stream;

c. contacting first liquid effluent stream in a second reaction zone at second reaction zone conditions of temperature and pressure in the presence of hydrogen and a second hydrocracking catalyst consisting essentially of a zeolite sensitive to nitrogen and hydrogen sulfide, and a catalytic metal selected from the group consisting of Group VIII, Group VIB and mixtures thereof, to form a second reaction zone effluent stream;

d. combining said second reaction zone effluent stream with said first gaseous effluent stream to form a combined stream prior to separation of a said second reaction zone effluent and passing said combined stream to a fractionation zone;

e. fractionating said combined stream at fractionation conditions to form at least one distillate product stream and at least one residual fraction stream; and f. recycling at least one residual fraction stream to either said first reaction zone or said second reaction zone or both.

2. The process of claim 1 wherein the entire residual fraction stream is recycled to said second reaction zone.

3. The process of claim 1 wherein said first gaseous phase is passed to a gaseous phase separation zone to remove nitrogen and hydrogen sulfide gases from said first gaseous phase before combination of said first gaseous phase with said second reaction zone effluent stream.

4. The process of claim 1 wherein said first reaction zone temperature and pressure are maintained in a range of 320 to 450° C. and 50 to 250 bar.

5. The process of claim 1 wherein said first reaction zone is maintained at a hydrogen/oil ratio of from 500 to 5000 N1/kg and a space velocity of from 0.1 to 10 kg/1/h.

6. The process of claim 1 wherein said first hydrocracking catalyst is an alumina-based catalyst comprising a group 8 or group **6*b*** metal deposited thereon.

7. The process of claim 1 wherein said second reaction zone conditions include a pressure and temperature in a range of 300 to 425° C. and 5 to 250 bar.

8. The process of claim 1 wherein said second reaction zone conditions include a space velocity from 0.1 to 10 kg/1/h and a hydrogen/oil ratio of from 250 to 5000 N1/kg.

* * * * *